US007972287B2

(12) United States Patent
Stewart et al.

(10) Patent No.: US 7,972,287 B2
(45) Date of Patent: Jul. 5, 2011

(54) HEAT TRANSFER CUFF

(75) Inventors: Thomas P. Stewart, Orchard Park, NY (US); Karl Hans Cazzini, Orchard Park, NY (US); Donald Woodworth, East Amherst, NY (US)

(73) Assignee: Gaymar Industries, Inc., Orchard Park, NY (US)

( * ) Notice: Subject to any disclaimer, the term of this patent is extended or adjusted under 35 U.S.C. 154(b) by 1251 days.

(21) Appl. No.: 11/588,583

(22) Filed: Oct. 27, 2006

(65) Prior Publication Data

US 2008/0064992 A1 Mar. 13, 2008

Related U.S. Application Data

(60) Provisional application No. 60/843,030, filed on Sep. 8, 2006.

(51) Int. Cl.
*A61H 7/00* (2006.01)
*A61H 9/00* (2006.01)

(52) U.S. Cl. ..... 601/7; 601/15; 601/149; 601/151

(58) Field of Classification Search ..... 601/6, 7, 601/10, 11, 15, 16, 22, 148, 149, 150, 151, 601/152; 607/96
See application file for complete search history.

(56) References Cited

U.S. PATENT DOCUMENTS 2,531,074 A 11/1950 Miller
4,091,804 A 5/1978 Hasty
4,269,175 A 5/1981 Dillon
4,311,135 A 1/1982 Brueckner et al.
4,343,302 A 8/1982 Dillon
4,396,010 A 8/1983 Arkans
4,597,384 A 7/1986 Whitney
4,989,589 A 2/1991 Pekanmäki et al.
5,080,089 A 1/1992 Mason et al.
5,186,163 A 2/1993 Dye
5,383,894 A 1/1995 Dye
5,496,262 A * 3/1996 Johnson et al. ..... 601/152
5,554,103 A 9/1996 Zheng et al.
5,591,200 A 1/1997 Cone et al.
5,626,556 A 5/1997 Tobler et al.
5,683,438 A 11/1997 Grahn et al.
5,795,312 A 8/1998 Dye
5,830,164 A 11/1998 Cone et al.
5,876,359 A 3/1999 Bock et al.
5,997,540 A 12/1999 Zheng et al.
6,135,116 A * 10/2000 Vogel et al. ..... 601/152
6,176,869 B1 1/2001 Mason et al.
6,336,907 B1 * 1/2002 Dono et al. ..... 601/150
6,602,277 B2 8/2003 Grahn et al.
6,656,208 B2 12/2003 Grahn et al.
6,673,099 B2 1/2004 Grahn et al.
6,966,922 B2 11/2005 Grahn et al.
6,974,442 B2 12/2005 Grahn et al.
7,122,047 B2 10/2006 Grahn et al.

* cited by examiner

*Primary Examiner* — Quang D Thanh
(74) *Attorney, Agent, or Firm* — Warner Norcross & Judd LLP

(57) ABSTRACT

The present invention is directed to a device that provides thermal energy therapy, compression therapy and negative pressure therapy simultaneously and/or in conjunction with each therapy. The outcome of the present invention is that a patient's bodily fluids can be maintained, controlled, and/or adjusted with decreased medication dependence. Using these three therapies individually does not obtain these desired results of controlling, maintaining or adjusting the patient's bodily fluid. This combination of therapies is beneficial to the patient.

24 Claims, 1 Drawing Sheet

HEAT TRANSFER CUFF

CLAIM OF PRIORITY

This application claims priority to U.S. provisional patent application Ser. No. 60/843,030 filed on Sep. 8, 2006.

FIELD OF THE INVENTION

The present invention relates generally to a human body circulatory aid and/or thermal energy transfer.

BACKGROUND OF THE INVENTION

DVT Apparatuses

Gaymar Industries, Inc. is the assignee of this application and expired U.S. Pat. No. 4,597,384. The '384 patent is incorporated herein by reference as disclosing a well-made deep vein thrombosis cuff. In the '384 patent, Gaymar wrote, "[T]herapeutic and prophylactic devices for the alleviation of deep venous thrombosis by mechanical as opposed to chemical means. Deep venous thrombosis (DVT) is a condition in which clotting of venous blood occurs generally in the lower extremities due to lack of sufficient muscular activity in the lower extremities. Thus it is important that the velocity of blood flow in the patient's extremities be maintained at the requisite level in order to prevent pooling of blood in such extremities so that stasis of blood will not develop. This is particularly important since it is well known that stasis of blood is a significant cause leading to the formation of thrombi in the patient's extremities which could ultimately cause the death of the patient.

Devices are presently in use for the purpose of increasing blood velocity to prevent problems set forth above. Many of these devices comprise compression sleeves which fit over and around the limb requiring care. Fluid pressure producing means are provided for sequentially inflating the compression sleeve and allowing for a simultaneous deflation of all sleeve components.

Applicant's U.S. Pat. No. 4,453,538 which is entitled "Medical Apparatus" and issued on Jun. 12, 1984, is hereby and herewith incorporated for all of its disclosure into this application. Among other features this patent describes a flexible pad formed for external enwrappment about a patient's limb. The pad includes a plurality of relatively large individual fluid receiving cells adapted to receive and retain sufficient fluid to exert pressure upon the enwrapped limb for a specified period of time. More particularly, the cells are sequentially pressurized starting at the limb extremity and proceeding in the direction of the patient's heart. It is desirable that the sleeve compression pressure proceed smoothly and [progressively] along the patient's limb from the extremity heartward. Most pressure sleeves currently in use cannot do this. In fact most of them leave continuous pressure gaps between respective sleeve portions. Such results are undesirable.

In view of the foregoing it is an object of [the '384 patent] to provide a compression sleeve for a patient's limb which will provide a smooth pressure flow with no pressure gaps extending completely around the patient's limb.

It is yet another object of [the '384 patent] to provide a device for use in applying successive compressive pressures against a patient's limb to produce a smooth pumping action from the patient's limb extremity heartward.

It is a still further object of [the '384 patent] to provide a sleeve for use in applying compressive pressures against a patient's limb wherein the sleeve comprises a plurality of laterally extending separate fluid pressure members arranged longitudinally along the sleeve from a lower portion of the encased limb to the upper portion thereof with the adjacent lateral edge portions of adjacent pressure members being curved upwardly and then downwardly in unison whereby the respective contiguous edges thereof follow each other so that when pressure is sequentially applied from the lowermost pressure members upward there will never be a continuous circumferential pressure gap on any lateral circular portion of the encased limb.

Another object of [the '389 patent] is to provide a device of the type described in the proceeding object and further wherein the successive pressurization of each pressure member from the lowermost heartward produces a plurality of circumferential spaced radially inward maximum and minimum forces interdigitated with successive pressure members having similar maximum and minimum forces to produce a smooth gap free pressurization from start to finish."

Gaymar's apparatus is just one of many types of deep vein thrombosis (DVT) apparatuses. There are numerous designs for such DVT apparatuses. Representative samples of such DVT apparatus designs are found, and hereby incorporated by reference, in the following U.S. Pat. No.: 2,531,074 to Miller, Nov. 21, 1950; U.S. Pat. No. 4,091,804 to Hasty, May 30, 1978; U.S. Pat. No. 4,269,175 to Dillon, May 26, 1981; U.S. Pat. No. 4,343,302 to Dillon, Aug. 10, 1982; U.S. Pat. No. 4,396,010 to Arkans, Aug. 2, 1983; U.S. Pat. No. 4,989,589 to Pekanmaki et al., Feb. 5, 1991; U.S. Pat. No. 4,311,135 to Brueckner et al., Jan. 19, 1982; U.S. Pat. No. 5,080,089 to Mason et al., Jan. 14, 1992; U.S. Pat. No. 5,186,163 to Dye, Feb. 16, 1993; U.S. Pat. No. 5,383,894 to Dye, Jan. 24, 1995; U.S. Pat. No. 5,554,103 to Zheng et al., Sep. 10, 1996; U.S. Pat. No. 5,591,200 to Cone et al., Jan. 7, 1997; U.S. Pat. No. 5,626,556 to Tobler et al., May 6, 1997; U.S. Pat. No. 5,795,312 to Dye, Aug. 18, 1998; U.S. Pat. No. 5,830,164 to Cone et al., Nov. 3, 1998; U.S. Pat. No. 5,876,359 to Bock et al., Mar. 2, 1999; U.S. Pat. No. 5,997,540 to Zheng et al., Dec. 7, 1999; and U.S. Pat. No. 6,176,869 to Mason et al., Jan. 23, 2001.

Some of the above-identified references disclose DVT apparatuses having a therapy pad with at least two chambers and each chamber receives, through a conduit, a fluid from a source (a "fundamental compression therapy pad design"). The fluid can (a) return to the source through a return conduit or the original conduit ("recirculation systems"), (b) be directed toward a receiving unit (not the source) through a return conduit ("receiving system"), or, alternatively, (c) permeate through apertures in the chambers (normally using air as the fluid and commonly referred to as a "low air-loss system"). The alternative method is preferred if the fluid is a gas; and the former methods are desired if the fluid is a liquid (like an aqueous fluid or a non-aqueous fluid) or a gas (like air). In any case, the fluid is pressurized. The fluid pressure in each chamber can be the same or different, depending on the desired result. For example, the fluid in:

(a) chamber 1 is 50 mm Hg, chamber 2 is 50 mm Hg and so on; (Uniform pressure)
(b) chamber 1 is 80 mm Hg, chamber 2 is 40 mm Hg, and chamber 3 is 20 mm Hg; (Sequential downward pressure)
(c) chamber 1 is 60 mm Hg, chamber 2 is 40 mm Hg, chamber 3 is 60 mm Hg, and chamber 4 is 20 mm Hg; (Alternating Uniform/Sequential Downward Pressure)
(d) chamber 1 is 50 mm Hg, chamber 2 is 30 mm Hg, chamber 3 is 50 mm Hg, and chamber 4 is 30 mm Hg; (Alternating distinct uniform pressure) or
(e) combinations thereof.

The fluid can also have a desired temperature. As disclosed in U.S. Pat. No. 2,531,074 to Miller at col. 1, lines 50-56; DVT apparatus can control the fluid temperature. The fluid temperature, however in the cited references, is uniform in each chamber of the therapy pad.

The fluid receiving cells can be made of a single material or a plurality of materials. Whatever number of materials are used, the material that contacts the patient's skin should be of a material or combination of materials that effectively transfers thermal energy to the patient or receives thermal energy from the patient (hereinafter "Transfer Material"). Examples of such transfer materials that have been used in the past include and are not limited to polymeric materials like polyethylene, polymeric materials with metallic materials (like rivets) positioned on and within the polymeric material, metallic-polymeric materials, and metallic materials.

All of the above variations of (a) fluid pressures, (b) recirculation systems, (c) constant fluid temperature in each chamber, (d) air-loss systems, (e) compression DVT systems, and (f) fundamental compression therapy pad designs, revert at least to the late 1970's.

Hypo/Hyperthermia Control Devices

In this application, we need to also discuss hypo/hyperthermia blankets. One type of hyper/hypothermia blankets are forced-air blankets. Those blankets have been litigated for many years. One such case is Augustine Medical, Inc. v. Gaymar Indus., Inc. (the assignee of this application), 181 F. 3d 1291, 50 USPQ2d 1900 (Fed. Cir. 1999). In that case, Judge Radar concluded that Gaymar's forced-air blankets did not infringe any of Augustine's patents at issue, and wrote, "Convective thermal blankets inflate to direct warm (or cool) air onto a person. Surgeons often use these blankets during and after an operation to prevent or treat hypothermia caused by surgical conditions. Hypothermia results when a patient's body temperature drops below a certain threshold. Surgery often presents the threat of hypothermia. A patient's body temperature may drop significantly during surgery because anesthesia prevents the patient's body from regulating its own temperature. Additionally, operating rooms—kept cool to accommodate the surgeon's working conditions and to reduce the spread of germs—can chill patients. Moreover, surgery often calls for administration of cool intravenous fluids at a time when the patient's body cavity is open.

A convective thermal blanket over the patient is thus necessary to prevent or treat hypothermia during and after surgery. Heated air from a warming unit inflates the blanket. Once inflated, the blanket directs heated air onto the patient through small holes (or "exit ports") in the undersurface of the blanket. With careful use, a convective blanket regulates patient temperature and prevents hypothermia . . . . [Gaymar's blankets] feature an inflatable quilt-like structure [, . . . ] attach two sheets of the same amount of flexible, lightweight material around their periphery and at various spots along their surfaces. In operation, heated air flows onto a patient's body from holes in the undersurface of [Gaymar's blankets], but [Gaymar's blankets] do not form a self-supporting or Quonset hut-like structure. Instead, [Gaymar's blankets] lie flat when inflated on a flat surface and rest substantially on a patient when in use . . . . Gaymar began selling forced-air blankets in March 1992." And one of those blankets is Gaymar's THERMACARE quilt.

Alternatively, other types of hypo/hyperthermia blankets are sold by Gaymar. An example of these blankets is Gaymar's DHP 600 hyper/hyperthermia blanket. That blanket operates differently from the forced-air blankets. Those blankets overlay a user and receive a fluid having a predetermined temperature. The fluid circulates through a cavity defined in the blanket that is to be positioned on a patient. The fluid (a) transfers its thermal energy to the patient and/or (b) receives the patient's thermal energy to control the patient's body core temperature. A description of those blankets is set forth in U.S. Pat. No. 6,375,673, which is hereby incorporated by reference in this application and which is licensed to the assignee of this application.

These blankets are extremely effective in altering the body core temperature of a patient. A problem with these devices is that some people claim those prior art hypo/hyperthermia blankets are bulky and difficult to use because those blankets cover too much of the patient. To address that problem, applicants have found a solution. The solution is set forth in the present application.

Negative Therapy Devices

Stanford University is the assignee of U.S. Pat. Nos. 5,683,438; 6,602,277; 6,673,099; 6,656,208; 6,966,922; 7,122,047; and 6,974,442. These patents disclose devices that create a negative pressure about a portion of a patient's body having a venous plexus. A venous plexus is a vascular network formed by numerous anastomoses between veins. The venous plexus is normally located at the patient's foot area and hand area. The negative pressure is applied, and simultaneously thermal energy (cold or warm) is applied to the venous plexus area that is subject to negative pressure.

Applying a negative pressure condition to a portion of the body (a) lowers the vasoconstriction temperature and/or (b) increases vasodilation in the body portion that is enclosed. The negative pressure conditions may be provided using any convenient protocol. In many embodiments, the negative pressure conditions are provided by enclosing a patient's venous plexus area in a sealed enclosure, where the pressure is then reduced in the sealed enclosure thereby providing the desired negative pressure. In many of the embodiments, the negative pressure is allowed to leak to the ambient environment through a seal so it does not create a tourniquet effect. A tourniquet effect is undesirable because it terminates the blood flow which is contrary to the intent of Stanford's negative pressure, thermal energy device.

Negative pressure includes conditions where a pressure is lower than ambient pressure under the particular conditions in which the method is applied, e.g., 1 ATM at sea level. The magnitude of the decrease in pressure from the ambient pressure under the negative pressure conditions in one example is at least about 20 mmHg, preferably at least 30 mmHg, and more preferably at least about 35 mmHg, where the magnitude of the decrease may be as great as 85 mmHg or greater, but preferably does not exceed about 60 mmHg, and more preferably does not exceed about 50 mmHg. When the method is performed at or about sea level, the pressure under the negative pressure conditions generally may range from about 740 to 675 mmHg, preferably from about 730 to 700 mmHg and more preferably from about 725 to 710 mmHg.

In practicing the exemplary methods, the negative pressure conditions during contact with the patient's skin may be static/constant or variable. Thus, in certain examples, the negative pressure is maintained at a constant value during contact of the surface with the low temperature medium. In yet other examples, the negative pressure value is varied during contact, e.g., oscillated. Where the negative pressure is varied or oscillated, the magnitude of the pressure change during a given period may be varied and may range from about 85 to 40 mmHg, and preferably from about 40 to 0 mmHg, with the periodicity of the oscillation ranging from about 0.25 sec to 10 min, and preferably from about 1 sec to 10 sec.

The negative pressure is applied to the certain venous plexus area to create vasodilation. That vasodilation results in the thermal energy (1) effectively transferring its thermal energy to the patient to warm the patient's body core temperature, or (2) effectively receiving the patient's thermal energy to cool the patient's body core temperature.

Stanford University disclosed that the thermal energy can be provided from outside the enclosure—for example a heat lamp—if the enclosure allows such thermal energy to penetrate through it or within the enclosure. Within the enclosure, the thermal energy can be provided by an electric thermal blanket or pad; or a conductive conduit or pad that allows a fluid having a desired temperature to flow through it. In both internal thermal energy providing embodiments and variations thereof, the patient's venous plexus is applied to the thermal energy providing device to transfer thermal energy to the patient and/or receive thermal energy from the patient.

"Third Space" in the Human Body

Current scientific literature reveals that inflammatory mediators initiate a biochemical chain of events that increase capillary permeability. These mediators include pharmacologically active amines such as histamine and 5-hydroxytryptamine, polypeptides such as bradykinin, kallikrein and leukotoxine, the prostaglandins, and various complements including derivatives thereof. These mediators act specifically on the junction of the endothelial cells of capillaries so that the junctions cannot contain colloids such as serum albumin within the vessel. The serum albumin escapes into the interstitium creating a nonfunctional "third space", the volume of which increases proportionally to albumin leakage and the presence of cytokines as well as proteolytic enzyme activities within the matrix. This leakage further widens capillary membrane-mitochondrial distances creating problems of poor diffusion and transport between the circulatory system and the functional cells resulting in cellular anoxia, a cellular energy deficit, and acidosis, and possibly leading to sequential organ failure.

In the past, the problem of the creation of the third space has been approached through pharmacological means. The present invention approaches the problem by controlling the patient's temperature, applying compression therapy to the patient and/or applying pressure therapy to the patient.

SUMMARY OF THE INVENTION

The present invention is directed to a device that provides thermal energy therapy, compression therapy and negative pressure therapy simultaneously and/or in conjunction with each therapy. The outcome of the present invention is that a patient's bodily fluids can be maintained, controlled, and/or adjusted with decreased medication dependence. Using these three therapies individually does not obtain these desired results of controlling, maintaining or adjusting the patient's bodily fluid. This combination of therapies is beneficial to the patient.

DETAILED DESCRIPTION OF THE INVENTION

The present invention is a combination of a compression therapy, thermal therapy and pressure therapy to operate in concert with each other to treat more than just deep vein thrombosis and body core temperature. The combination is designed to move bodily fluids in the lymphatic system, secondary venous system, and artery system in a controllable manner to obtain desired results. Desired results include and are not limited to controlling and/or manipulating the patient's blood pressure and bodily fluid volume. By controlling and/or manipulating the patient's blood pressure and bodily fluid, the present invention offers more medical assistance than expected.

Applying cold thermal energy therapy causes vasoconstriction and warm thermal energy therapy causes vasodilation. Compression therapy causes vasoconstriction and moves the blood in the direction of the compression therapy—normally toward the heart. Cold thermal energy therapy and compression therapy increases the patient's blood pressure. However, cold thermal energy therapy, compression therapy and negative pressure therapy reperfuses blood (and other bodily fluids) from the third space. Obviously, too much cold thermal energy therapy, compression therapy and negative pressure therapy is not good, therefore the present invention is able to provide the opposite therapy to obtain the desired balance for the desired results. This combination of therapies have never been incorporated together to control the bodily fluids, including an not limited to cardiac output control. Instead, medication in combination with one of these therapies has been standard bearer up to today.

Figure 1:
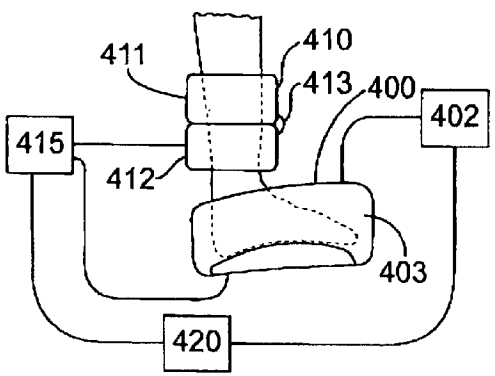
FIG. 1 illustrates a schematic drawing of a first embodiment of the present invention.

As illustrated in FIG. 1, the present invention can be a conventional negative pressure, thermal energy device 400 and a conventional compression therapy device 410 interconnected to a controller 420 to operate both devices simultaneously and/or in conjunction with each other to obtain the desired results. An example of the conventional negative pressure, thermal energy device 400 is manufactured by AVA-Core's core control device (located in Ann Arbor, Mich.). An example of the conventional compression therapy device 410 is disclosed in Gaymar's U.S. Pat. No. 4,597,389. FIG. 1 illustrates these devices 400 and 410 positioned about a patient's foot and leg, but FIG. 1 is merely being used for illustrative purposes and it is understood that these devices, individually or collectively, can also be positioned on the foot, the leg, a hand, an arm, a hand and an arm, and combinations thereof.

The thermal energy provided to the conventional negative pressure, thermal energy device 400 and the conventional compression therapy device 410 can come from the same source or different sources 415. The sources can be (a) fluid providers such as Gaymar's MEDI-THERM heating/cooling unit; Gaymar's THERMACARE device; electrical sources; and/or air or fluid pumps with coolers and/or heaters; (b) electrical providers (not applicable for the conventional compression therapy device 410); (c) irradiant heat devices like a heat lamp (not applicable for the conventional compression therapy device 410) or (d) combinations thereof.

Figure 2:
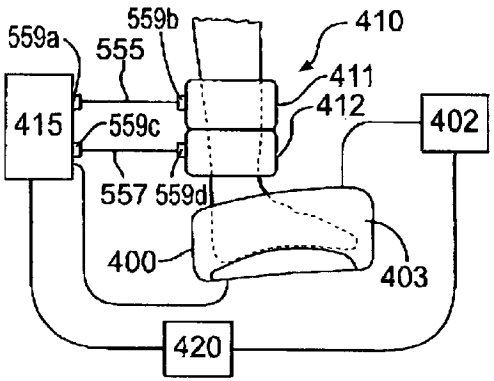
FIG. 2 illustrates an alternative embodiment of FIG. 1.

Some of those sources can provide thermal energy at a single temperature. Other sources can provide thermal energy at various temperatures. And other sources can provide a fluid to (a) the conventional compression therapy device 410 at temperature T1 and (b) the conventional negative pressure, thermal energy device 400 at temperature T2, wherein T1 and T2 can be the same or different. Moreover, some sources can provide a fluid to (a) the conventional compression therapy device 410 at temperature T1 for a first fluid pressure member 411 and at temperature T2 for a second fluid pressure member 412 (as illustrated in FIG. 2) and (b) the conventional negative pressure, thermal energy device 400 at temperature T2, wherein T1, T2, and T3 can be the same, different, or combinations thereof.

In addition to controlling the temperature of the fluid's thermal energy that enters the conventional compression therapy device 410, the thermal energy source 415 controls the pressure of the fluid that enters the conventional compression therapy device 410 as illustrated in FIG. 1. Alternatively and as illustrated in FIG. 2, the thermal energy source 415 can provide a fluid having (a) a first pressure (P1) to the first fluid pressure member 411 and (b) a second pressure (P2) to the second fluid pressure member 412, wherein P1 and P2 can be the same or different.

The compression therapy device 410 can offer static compression therapy, sequential compression therapy, or variations thereof.

Reverting to FIG. 1, the first fluid pressure member 411 is interconnected to the second fluid pressure member 412 through a conduit 413. Depending on the shape and size of the conduit 413, conduit 413 can maintain or adjust the fluid pressure that enters the second fluid pressure member 412 from the first fluid pressure member 411. For example, if the conduit 413 tapers from the first fluid pressure member 411 to the second fluid pressure member 412 then the fluid pressure is greater in the second fluid pressure member 412 than the first fluid pressure member 411. If the conduit 413 tapers in the opposite direction, then the fluid pressure in the first fluid pressure member 411 is greater than the fluid pressure in the second fluid pressure member 412.

The negative pressure created in the conventional negative pressure, thermal energy device 400 is provided by a conventional negative pressure providing device 402. The conventional negative pressure providing device 402 can be any system that creates negative pressure within the enclosure of the conventional negative pressure, thermal energy device 400. The negative pressure is created in the enclosure of the conventional negative pressure, thermal energy device 400 at area 403.

The controller 420 has an input system that allows a user to program (a) when to operate the thermal energy source(s) 415 and negative pressure providing device 402, (b) how much (i) thermal energy is directed from the thermal energy source 415 to the conventional negative pressure, thermal energy device 400 and the conventional compression therapy device 410 and (ii) negative pressure to create in the conventional negative pressure, thermal energy device 400, and (c) the temperature of the thermal energy directed to the conventional negative pressure, thermal energy device 400 and the conventional compression therapy device 410. The controller 420 can be electrically interconnected to the conventional negative pressure, thermal energy device 400 and the conventional compression therapy device 410, or alternatively, the user could manually operate each device separately. The former embodiment is preferred because it provides the opportunity to control the devices simultaneously and in conjunction with each other to obtain the desired results.

Figure 3:
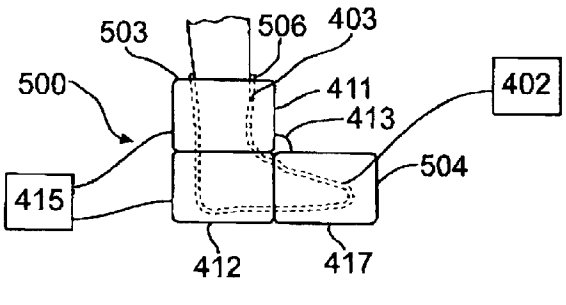
FIG. 3 illustrates a third alternative embodiment of FIG. 1.

FIGS. 1 and 2 illustrated that the conventional negative pressure, thermal energy device 400 and the conventional compression therapy device 410 are separate devices. FIG. 3 illustrates that the conventional negative pressure, thermal energy device 400 and the conventional compression therapy device 410 can be combined together to form a single unit device 500.

The single unit device 500 encloses the patient's body part (hand, arm, hand and arm, leg, foot, or leg and foot). The single unit device 500 has a proximal end 503 and a distal end 504. The distal end 504 is sealed. The proximal end 503 has an opening that allows a patient's body part to enter into the single unit device 500. The proximal end 503 has a leaky seal 506.

The leaky seal 506 allows the area 403 to have and maintain a negative pressure environment without creating a tourniquet effect to the patient. Area 403 is positioned between fluid pressure members 411, 412 and 417 and the patient's skin.

Third fluid pressure member 417 operates in the same way as fluid pressure members 411 and 412 as described above. That means fluid pressure member 417 receives a fluid from thermal energy source 415 at temperature T4 wherein T1, T2, T3 and T4 can be the same, different, or combinations thereof. Likewise, the fluid pressure in the third fluid pressure member 417 can be P3, wherein P1, P2 and P3 can be same, different or combinations thereof.

The thermal energy therapy is provided to the patient through the fluid pressure members 411, 412, and 417. Simultaneously or not, fluid pressure members 411, 412, and 417 can be providing compression therapy to the patient.

Figure 4:
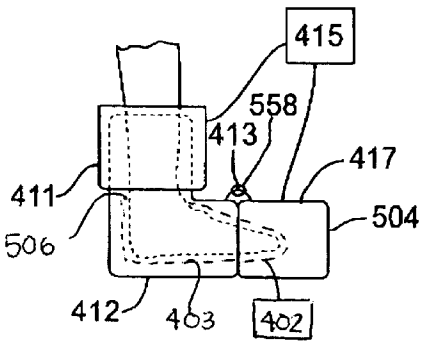
FIG. 4 illustrates a fourth alternative embodiment of FIG. 1.

Alternatively, the seal 506 can be positioned anywhere within fluid pressure members 411, 412 and 417, not just at the proximal end 503, as illustrated in FIG. 4.

Alternative Embodiments

The compression therapy unit 410 or the single unit device 500 can use a fluid recirculation system, a receiving system, or, a low air-loss system (only with a gaseous fluid).

As illustrated in FIG. 2, the thermal energy source 415 provides a first fluid having T1 and P1 to the first fluid pressure member 411 through conduit 555 and a second fluid (the second fluid and the first fluid can be the same fluid or different fluids) having T3 and P2 to the second fluid pressure member 412 through conduit 557. Conduits 555 and 557 interconnect to the respective member 411, 412 and the fluid source 415 through a quick disconnect interconnection system (for example a Colder quick disconnect unit) 559*a-d*. A quick disconnect interconnection system allows a user to disconnect the conduits from either the respective member 411, 412 and the fluid source 415 and connect the conduits to different members or different outlets of the fluid source. In other words, the older interconnection system or equivalent thereof allows the member 411 to originally have the first fluid, then the second fluid and then the first fluid again.

In another embodiment illustrated in FIG. 4, the first fluid pressure member 411 overlies at least a portion of the second fluid pressure member 412. In each member 411, 412, the pressure may or may not be the same. The temperature in each member 411, 412 can be the same or different. The fluid that enters each member 411, 412 can also be the same or different. This embodiment ensures that the desired pressure is applied and in some cases increased at the transition point between the fluid pressure members 411, 412.

The conduit 413 can also be an orifice between two fluid pressure members. For example, the orifice can be an opening within heat sealed members that allows fluid to flow between the members. The orifice and the conduit 413 can also have check valves or membrane valves, not shown, that prevent the fluid from re-entering a particular fluid pressure member. Examples of membrane valves include and are not limited to tricuspids designs, bicuspids designs, poppet styles or flap designs.

Alternatively, the conduit 413 can have a thermal energy adjuster 558. The thermal energy adjuster 558 has the capability to alter the temperature of the fluid going between two fluid pressure members. The thermal energy adjuster 558 is any conventional device that can alter a fluid's temperature.

An example of a thermal energy adjuster 558 is thermal coil in, exterior to, or combinations thereof to the conduit 558. Another example is a thermal blanket on the exterior surface of the conduit 558.

The present invention is positioned on a patient and a medical person monitors the patient's blood pressure, body core temperature, heart rate, and heart rhythms. Depending on the patient's presentation, the medical person (or persons) alters the present invention's therapies (compression, thermal energy and negative pressure) to obtain the desired result. It has been confirmed this invention can control and/or manipulate the flow of the patient's blood (and other bodily fluids) without medication. Obviously, the present invention solves a problem by potentially decreasing the quantity of patient medication.

It is appreciated that various modifications to the inventive concepts described herein may be apparent to those of ordinary skill in the art without departing from the scope of the present invention as defined by the herein appended claims.

We claim:

1. A compression, thermal energy and negative pressure therapies device comprising:

a compression therapy device having first chamber and a second chamber wherein the first chamber and the second chamber are both positioned on a patient's same arm or leg, the compression therapy device encloses a first portion of the patient to provide sequential compression therapy to the patient, the first chamber receives a first fluid;

a first fluid source that provides the first fluid having a first pressure and a first temperature to provide a first thermal therapy to the patient's appendage;

a negative pressure enclosure encompassing the first portion of the patient and a negative pressure provider device that creates a negative pressure atmosphere in the negative pressure enclosure to provide negative pressure therapy to the patient to promote vasodilation or vasoconstriction;

wherein the compression therapy, the thermal energy therapy and the negative pressure therapy are used simultaneously or in conjunction with each other to control and manipulate the flow of the patient's blood.

2. The device of claim 1 wherein the negative pressure enclosure is positioned between the compression therapy device and the patient.

3. The device of claim 1 wherein the first chamber and the second chamber are in different areas, and the second chamber receives a second thermal energy therapy.

4. The device of claim 3 wherein the second thermal energy therapy is provided by a device selected from the group consisting of the first fluid source, a second fluid source that provides a second fluid having a second temperature and a second pressure, an electrical thermal device, an irradiant heat device, or combinations thereof.

5. The device of claim 1 wherein the second chamber receives the first fluid from the first chamber.

6. The device of claim 5 wherein the first fluid in the second chamber has a different temperature than the first fluid in the first chamber.

7. The device of claim 5 wherein the first fluid in the second chamber has a different pressure than the first fluid in the first chamber when the first fluid passes through a conduit from the first chamber to the second chamber.

8. The device of claim 1 wherein the second chamber receives a second fluid.

9. The device of claim 8 wherein the second fluid comes from the first fluid source.

10. The device of claim 9 wherein the second fluid has a different temperature than the first fluid.

11. The device of claim 9 wherein the second fluid has the same temperature as the first fluid.

12. The device of claim 9 wherein the second fluid has a different pressure than the first fluid.

13. The device of claim 9 wherein the second fluid has the same pressure as the first fluid.

14. The device of claim 8 wherein the second fluid is the same as the first fluid.

15. The device of claim 1 wherein the first chamber is positioned over a portion of the second chamber.

16. The device of claim 1 wherein the first portion of the patient has a venous plexus area.

17. The device of claim 1 further comprising a controller to operate and maintain the first fluid source and the negative pressure provider device.

18. The device of claim 1 wherein the first fluid is selected from the group consisting of air, water, aqueous liquids, non-aqueous liquids and combinations thereof.

19. The device of claim 1 wherein when the first chamber or the second chamber is filled or in the process of being filled with the fluid, the other chamber is empty or emptying the fluid from the chamber.

20. The device of claim 5 wherein the first fluid enters the second chamber through an orifice, a valve, a conduit, or combinations thereof.

21. The device of claim 1 wherein the first fluid is below the patient's core temperature.

22. The device of claim 1 wherein the first fluid is above the patient's core temperature.

23. The device of claim 1 wherein the first fluid is the patient's core temperature.

24. The device of claim 1 wherein patient's blood pressure is altered by adjusting or maintaining the volume in the patient's third space.

* * * * *